US009433854B1

(12) United States Patent
D'Alessandro

(10) Patent No.: US 9,433,854 B1
(45) Date of Patent: Sep. 6, 2016

(54) DEVICE AND METHOD FOR REMOVING SCRATCH-OFF COATINGS

(71) Applicant: Andre D'Alessandro, Parsippany, NJ (US)

(72) Inventor: Andre D'Alessandro, Parsippany, NJ (US)

( * ) Notice: Subject to any disclaimer, the term of this patent is extended or adjusted under 35 U.S.C. 154(b) by 0 days.

(21) Appl. No.: 14/621,649

(22) Filed: Feb. 13, 2015

(51) Int. Cl.
*A63F 3/06* (2006.01)
*B08B 1/00* (2006.01)
*A47L 13/26* (2006.01)

(52) U.S. Cl.
CPC ..... *A63F 3/068* (2013.01); *A47L 13/26* (2013.01); *B08B 1/001* (2013.01); *B08B 1/005* (2013.01)

(58) Field of Classification Search
CPC ..... A63F 3/068; B08B 1/00; B08B 1/001; B08B 1/003; B08B 1/005; B08B 1/006; B08B 2200/00; B08B 2240/00; B43K 29/00; B43K 29/02; B43K 29/05; B43K 29/18; A47L 1/06; A47L 1/08; A47L 1/15; A47L 13/17; A47L 13/26; A47L 25/00
USPC ..... 15/104.94, 105, 209.1, 210, 1, 236.01, 15/236.05–236.07, 244.1; 401/195, 196, 401/198, 199, 202
See application file for complete search history.

(56) References Cited

U.S. PATENT DOCUMENTS 902,671 A * 11/1908 Mauk ..... B43K 23/124 401/131
2,227,710 A * 1/1941 Finn ..... G02C 13/006 15/118
2,625,700 A 1/1952 Baldwin
2,726,416 A * 12/1955 Lepkowski ..... G02C 13/006 401/143
2,975,464 A * 3/1961 Schultz ..... A47L 23/05 206/229
3,195,544 A * 7/1965 Politzer ..... A45D 29/007 132/286
3,526,918 A 9/1970 Leland
4,511,678 A 4/1985 Mahnke et al.
4,652,163 A * 3/1987 Karliner ..... A47L 13/03 401/123
4,724,568 A 2/1988 Englehardt
4,777,693 A 10/1988 Diba et al.
5,127,720 A 7/1992 Shultz et al.
5,301,387 A 4/1994 Thomas et al.
5,301,687 A 4/1994 Wong et al.
5,351,356 A 10/1994 Townsend, Jr.
5,413,853 A 5/1995 Imashivo et al.
5,661,869 A * 9/1997 Grout ..... B05C 17/002 134/201
5,907,882 A 6/1999 Tyree
6,350,511 B2 2/2002 Thom
6,391,040 B1 5/2002 Christoudias (Continued)

FOREIGN PATENT DOCUMENTS

FR 2744952 * 8/1997

OTHER PUBLICATIONS

BASF Web Page describing Basotect.

*Primary Examiner* — Mark Spisich
(74) *Attorney, Agent, or Firm* — Thomas L. Adams

(57) ABSTRACT

A device and method can remove a scratch-off coating that initially conceals information. The device has a rubbing member including a melamine open cell foam. The device's structure includes a body with a fluid chamber that communicates with a distal opening. The rubbing member is mounted at this distal opening. The structure includes a scraping element located at the rubbing member. The melamine open cell foam and the scraping element are simultaneously pressed against and moved across the scratch-off coating until it is removed and retained in the foam sufficiently to reveal the concealed information.

15 Claims, 3 Drawing Sheets

(56) References Cited

U.S. PATENT DOCUMENTS

| | | | | |
|---|---|---|---|---|
| 6,629,330 | B2 | 10/2003 | Schultheis et al. | |
| 7,714,031 | B2 | 5/2010 | Baumgarti et al. | |
| 8,191,195 | B2 | 6/2012 | Nelson | |
| 8,206,820 | B2 | 6/2012 | Bogaerts et al. | |
| 8,250,698 | B2 | 8/2012 | Gavney, Jr. et al. | |
| 8,269,196 | B2 | 9/2012 | Hill | |
| 8,341,795 | B2 | 1/2013 | Michelson et al. | |
| 8,627,536 | B1 | 1/2014 | Vandosen | |
| 8,635,732 | B2 * | 1/2014 | DeDominicis | A47L 13/17 15/104.93 |
| 8,777,972 | B2 | 7/2014 | Burres | |
| 2002/0030181 | A1 | 3/2002 | Stroud | |
| 2005/0196224 | A1 * | 9/2005 | Breslin | A63F 3/0625 401/198 |
| 2007/0061991 | A1 | 3/2007 | Gonzales et al. | |
| 2007/0270088 | A1 | 11/2007 | Greenwood | |
| 2008/0122220 | A1 | 5/2008 | Brickwood et al. | |
| 2008/0216260 | A1 | 9/2008 | Silverman et al. | |
| 2009/0180826 | A1 * | 7/2009 | Guay | A45D 34/04 401/197 |
| 2009/0205152 | A1 | 8/2009 | Soller et al. | |
| 2009/0232582 | A1 * | 9/2009 | Fuqua | A63F 3/068 401/138 |
| 2010/0064458 | A1 | 3/2010 | Nelson | |

* cited by examiner

DEVICE AND METHOD FOR REMOVING SCRATCH-OFF COATINGS

BACKGROUND OF THE INVENTION

1. Field of the Invention

The present invention relates to scratch-off coatings and, in particular, to devices and methods employing different components in concert for removing the coating.

2. Description of Related Art

Instant-win scratch-off lottery tickets are very popular with various segments of the population. Symbols printed on the ticket indicate whether the gambler is holding a winning ticket, but these symbols are concealed initially under a removable coating. These tickets offer a certain amount of mystery, anticipation, and an immediate answer to the question: "did I win?"

Enthusiasts of this form of gambling will often buy a significant number of tickets in a single purchase. The task of removing the scratch-off coating from multiple tickets can be tedious, especially if one uses a common object such as a coin or key, which is often the case. Also, when a large number of tickets are purchased, the scrapings create a mess that is a nuisance to clean up. At times the scrapings can stick to a gambler's clothing, fingers, etc.

A known cleaning material uses an open cell melamine foam. This foam has a network of relatively hard connecting elements. This hardness enables the foam to act as an effective micro-abrasive. On the other hand, the connecting elements are able to bend somewhat, giving the material a soft feel. Also, the network of cells is so small that the material has the appearance of a dense, almost continuous material. In addition, small particles abraded from a work surface can be captured in the open cell network. Consequently, the cleaning can be done with just a simple rubbing motion, without the need to mop up dislodged dirt or grime.

Information about melamine open cell foam is contained in U.S. Pat. Nos. 4,511,678; 5,413,853; 6,350,511; and 7,714,031, as well as U.S. Patent Application Publication No. 2007/0061991.

This melamine foam material can be manufactured in various shapes. In some cases, slabs of the material can be purchased and later machined into a desired shape Such material can be purchased as Basotect™ foam from BASF, a worldwide business headquartered in the Federal Republic of Germany.

See also U.S. Pat. Nos. 2,625,700; 3,526,918; 4,724,568; 4,777,693; 4,777,693; 5,127,720; 5,301,387; 5,351,356; 5,907,882; 6,391,040; 6,629,330; 8,191,195; 8,206,820; 8,250,698; 8,269,196; 8,341,795; 8,627,536; and 8,777,972, as well as U.S. Patent Application Publication Nos. 2002/0030181; 2007/0270088; 2008/0122220; 2008/0216260; 2009/0205152; and 2010/0064458

SUMMARY OF THE INVENTION

In accordance with the illustrative embodiments demonstrating features and advantages of the present invention, there is provided a device for removing a scratch-off coating that initially conceals information. The device includes a rubbing member comprising an open cell foam. The device has a structure that includes a body with a distal opening and a fluid chamber communicating with the distal opening. The rubbing member is mounted at the distal opening. The structure also includes a scraping element located at the rubbing member.

In accordance with another aspect of the invention, there is provided a device for removing a scratch-off coating that initially conceals information. This device includes a compressible rubbing member. The device has a structure that includes a body with a distal opening and a fluid chamber communicating with the distal opening. The rubbing member is mounted at the distal opening. The structure also includes a scraping element located at the rubbing member.

In accordance with yet another aspect of the invention a method is provided for removing a scratch-off coating that initially conceals information. The method employs a melamine open cell foam and a scraper. The method includes the step of simultaneously pressing the melamine open cell foam and the scraper against the scratch-off coating. Another step is moving the melamine open cell foam and the scraper across the scratch-off coating until the scratch-off coating is removed and retained in the foam sufficiently to reveal the concealed information.

In accordance with still yet another aspect of the invention, there is provided a device for removing a scratch-off coating that initially conceals information. The device has a rubbing member with a distal end. The device also has a melamine open cell foam that is abrasive and wetted with water. The device includes a structure having a body with a distal opening. The body has an external surface with at least a portion thereof cylindrical. The rubbing member is mounted at the distal opening. The structure includes a scraping element located at the rubbing member. The body includes a neck at the distal opening with a rim surrounding at least part of the rubbing member. The body also has a fluid chamber and a holding chamber. The fluid chamber communicates with the distal opening. The holding chamber is located between the fluid chamber and the distal opening. The rubbing member is mounted in the holding chamber and extends to the distal opening. The holding chamber communicates with the fluid chamber and the distal opening. The body includes a transverse perforated wall between the fluid chamber and the holding chamber. This wall is opposite the distal opening. The body also includes absorbent batting and a wick routed from the fluid chamber to the holding chamber. The absorbent batting is mounted in the fluid chamber and is wetted with water. The device also has a cap sized to fit around the neck and to cover the rubbing element. The body has opposite the distal opening, a cavity adapted to hold the cap.

By employing devices and methods of the foregoing type, an improved technique is achieved for removing a scratch-off coating. In a disclosed embodiment, a device has a slender cylindrical body that can be held like a pen or marker. The body has two chambers: a fluid chamber with batting that holds a supply of water, and a holding chamber supporting a melamine open cell foam. The two chambers are separated by a transverse wall. A wick is routed from the fluid chamber through an aperture in the transverse wall, and into the holding chamber in order to wet the melamine foam.

The melamine foam protrudes through a neck region and out through a distal opening. A scraping element provided at the distal opening will cooperate with the melamine foam. In one embodiment the scraping element is a nail-like stub with a proximal shank coaxially embedded in the foam and supporting an exposed, flared head. In another embodiment the distal face of the foam is beveled and lies next to a separate scraping blade whose distal edge is parallel to the distal beveled face of the foam.

In yet another embodiment the scraping element is incorporated into the neck through which the melamine foam protrudes. At least a portion of the neck's rim is sharpened to provide a scraping edge.

The device can be used by pressing the melamine foam and the scraping element against the scratch-off coating of a lottery ticket. The foam and scraping element are rubbed against the scratch-off coating to act in concert. The foam can by itself abrade and remove the scratch-off coating, but not with the efficiency that is achieved when the scraping element is present. The scraping element can dislodge from the coating relatively large particles or flakes that are then comminuted by the abrasive foam. The melamine foam reduces the dislodged coating into small particles that can pass into the open cells of the foam. This particle transport is facilitated by the water contained in the foam, which water is supplied from the wet batting and wick in the body of the device. Consequently, the scratch-off coating can be removed without scattering scrapings that can otherwise sully the workplace or the gambler's hands and clothing.

When this task is completed, the gambler can retrieve a cap that has been temporarily stored on the proximal end of the device. Once retrieved, the cap can be placed on the neck of the device to cover the foam and prevent drying by evaporation.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
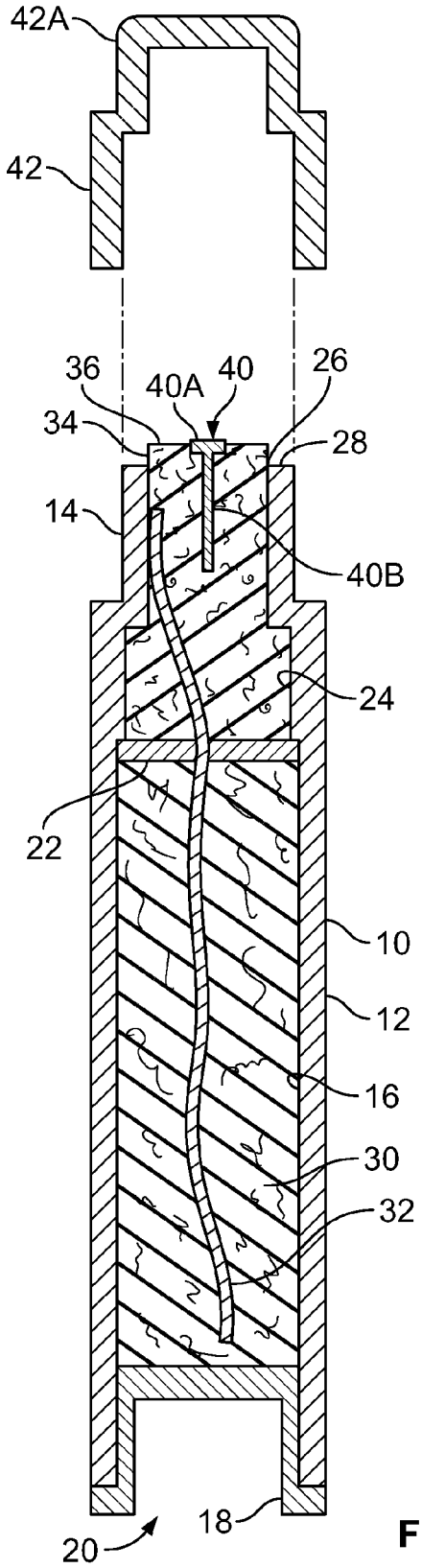
FIG. 1 is a longitudinal sectional view of a device in accordance with principles of the present invention.
Figure 2:
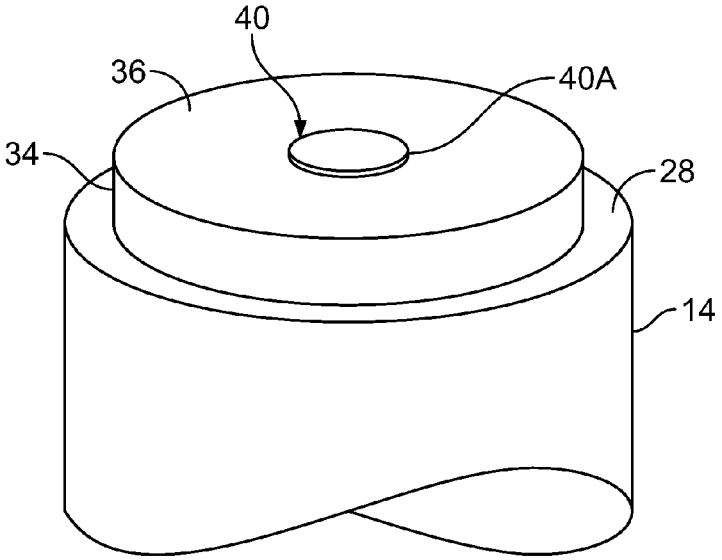
FIG. 2 is a detailed, fragmentary, axonometric view of the upper portion of the device of FIG. 1.

Referring to the device of FIGS. 1 and 2, a structure is shown having a tubular body 10 with a cylindrical external surface 12, adjacent to a neck 14 having a reduced outside diameter. Body 10 has a fluid chamber 16 that is closed on its proximal end by hat-shaped plug 18 having a cylindrical cavity 20. The distal end of chamber 16 is bordered by transverse perforated wall 22 separating chamber 16 from holding chamber 24, which has a reduced inside diameter in the space adjacent to wall 18. The space surrounded by neck 14, also part of the holding chamber 24, has an even further reduced inside diameter. Neck 14 terminates in a distal opening 26 surrounded by circular rim 28.

In this embodiment body 10 has an overall length of 4 inches (10 cm), and an outside diameter of ⅝ inch (1.6 cm), although different dimensions can be used in other embodiments depending on the desired capacity, portability, strength, etc.

Fluid chamber 16 contains absorbent batting 30 that is wetted with water to saturate or partially saturate the batting. Batting 30 may be a fibrous material having fibers made of cotton or other natural or synthetic fibers. In some cases, no batting will be used at all and chamber 16 will simply contain water. Water has the advantage of being widely recognized as being non-toxic, but other fluids can be used in different embodiments. Wick 32 is embedded in batting 30 and is routed through chamber 16, out a concentric aperture in wall 22, and into holding chamber 24. Wick 32 may be a cord similar to the wicks used in cigarette lighters.

Rubbing member 34 is mounted in the foregoing structure with its distal end 36 protruding from distal opening 26. Member 34 extends throughout neck 14 to provide a prominent cylindrical section that is integral with a larger-diameter cylindrical base adjacent to wall 22. Rubbing member 34 is shown filling all of holding chamber 24 and protruding from distal opening 26 approximately 0.4 inch (1.0 mm), although different amounts of protrusion can be employed in other embodiments. Also, the outside diameter of the distal portion of member 34 protruding from distal opening 26 has an outside diameter of ½ to ⅝ inch (1.4 to 1.6 cm), although this size can be varied depending upon the desired capacity, portability, working pressure, the expected size of the scratch-off coating, etc.

Member 34 may be an open cell foam that is compressible and has micro-abrasion properties. In this embodiment foam 34 is a melamine foam of the type often used in cleaning pads. For example, foam 34 may be Basotect™ foam manufactured by BASF. In some cases, member 34 may be molded into the illustrated shape. In other cases member 34 may be produced as a slab which is then cut and machined into the illustrated shape.

Wick 32 is shown routed from wall 22 and into a bore, groove or slice in melamine foam 34, although in some cases the wick may simply be routed around the outside of foam 34. Wick 32 extends through most of the length of foam 34, and the wick length is chosen to ensure an efficient transfer of water from the wick in order to adequately wet the foam.

The structure includes a scraping element, shown herein as scraper 40. Scraper 40 is a stud with a flared distal head 40A and a proximal shank 40B that is coaxially embedded into the distal end 36 of melamine foam 34. Head 40A extends slightly past distal end 36, although in some embodiments the head may extend further than illustrated or may be recessed in the foam. Scraper 40 may be made of hard plastic, a metal such as galvanized steel, or other materials. Shank 40B may be secured in place by adhesives, heat sealing, or by ridges or threads (not shown) formed in the shank. Shank 40B may be ¾ inch (1.9 cm) long, and head 40A may be a cylindrical disk with an outside diameter of ⅛ inch (3 mm), although other dimensions and shapes may be employed depending upon the room available, the desired attachment strength, the size of the region to be scraped, etc.

Cap 42 is shown as a cup-shaped member with a cylindrical opening sized to fit around snugly around neck 14. Cap 42 has a cylindrical nose 42A sized to fit snugly inside cavity 20 of plug 18.

To facilitate an understanding of the principles associated with the foregoing device, its operation will be briefly described in connection with FIGS. 1-3. Scraper 40 and wick 32 may be installed separately into foam 34. Thereafter wick 32 can be threaded through wall 22, which is then positioned adjacent to foam 34. Thereafter foam 34 and wall 22 can be inserted together from below and into the positions illustrated in FIG. 1.

With slight tension applied to wick 32, chamber 16 can be filled with batting 30 either by blowing batting fibers into the chamber or by inserting clumps of batting into the chamber 16 and around wick 32.

Thereafter, chamber 16 can be filled with water to fully or partially saturate batting 30. Consequently, wick 32 will draw water into foam 34, thereby wetting it. Chamber 16 is closed by inserting plug 18 into the illustrated position. Plug 18 can be secured by a friction fit, by adhesives, by heat sealing, etc. Cap 42 can be placed on neck 14 to prevent evaporation through foam 34.

Figure 3:
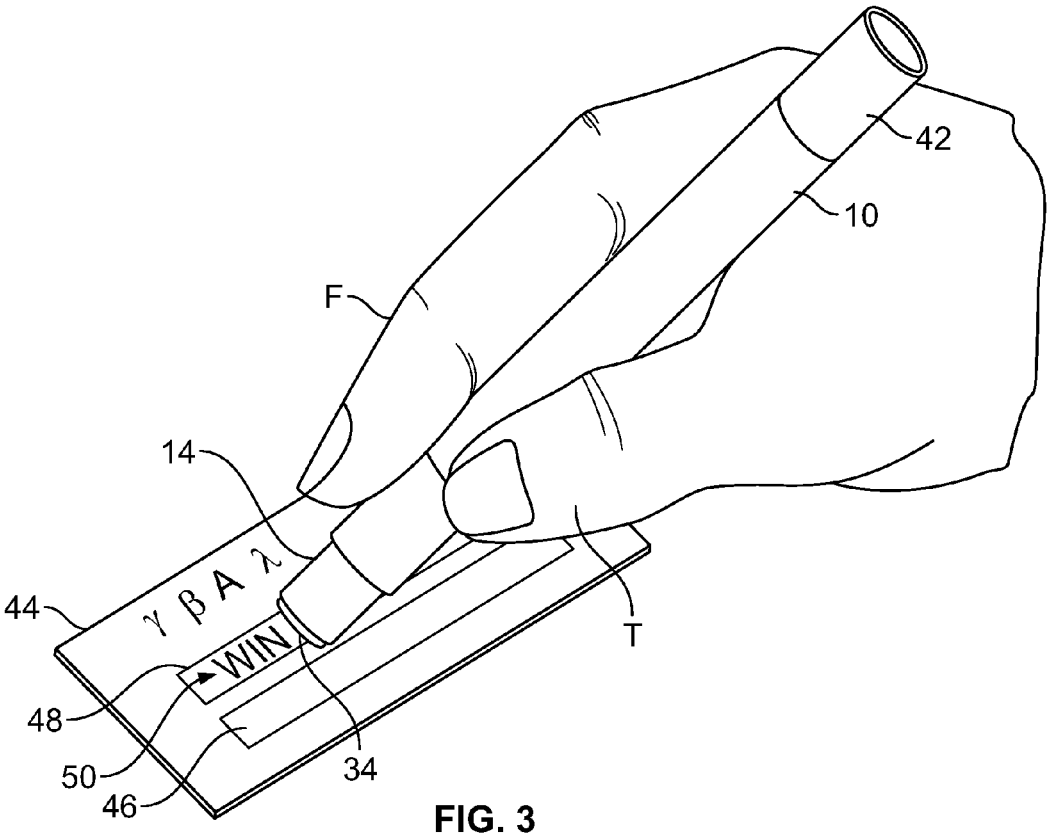
FIG. 3 is an axonometric view of the device of FIG. 1 being used to remove a scratch-off coating.

To use this device, a gambler will first remove cap 42 and insert nose 42A into cavity 20 as shown in FIG. 3. FIG. 3 shows a lottery ticket 44 with two parallel stripes, the lower stripe 46 being covered with a conventional scratch-off coating. It will be understood that upper stripe 48 initially had the same scratch-off coating at the time of purchase, but is shown being removed in this view.

Specifically, a gambler will grasp body 10 with thumb T, and fingers F (only one finger visible in this view) and swipe the stripe 48 from one end to the other with a back-and-forth motion. In some cases a single swipe may be sufficient to expose the previously concealed information 50 printed on stripe 48.

During this swiping, melamine foam 34 and scraper 40 will be simultaneously dragged across stripe 48. Scraper 40 will be more aggressive than foam 34 in dislodging the scratch-off coating (scratch-off coating as shown in stripe 46), although both will cooperate in removing this coating. Scraper 40 will tend to scrape off relatively large particles or flakes of the scratch-off coating, while foam 34 will abrade or grind portions of the coating that are either in their original place, or were dislodged by the scraper 40.

In any event, melamine foam 34 has micro-abrasive properties and is able to comminute the coating into fine particles, which can then be captured within the open cells of the foam. Since foam 34 is kept wet by batting 30 and wick 32, particles comminuted by the foam become suspended in water and can readily migrate into the open cell structure of the melamine foam 34. From the user's perspective, the scratch-off coating will seem to "disappear," because it immediately migrates into the melamine foam 34 as very fine particles.

This process can be repeated on the scratch-off coating on the lower stripe 46. If the gambler possesses more lottery tickets, the process can be repeated for these other tickets, and the work area will not be littered by the scrapings from the scratch-off coating.

When the device is no longer needed, nose 42A of cap 42 can be pulled from cavity 20. Thereafter cap 42 can be placed over neck 14 to cover foam 34 and prevent evaporation.

Figure 4:
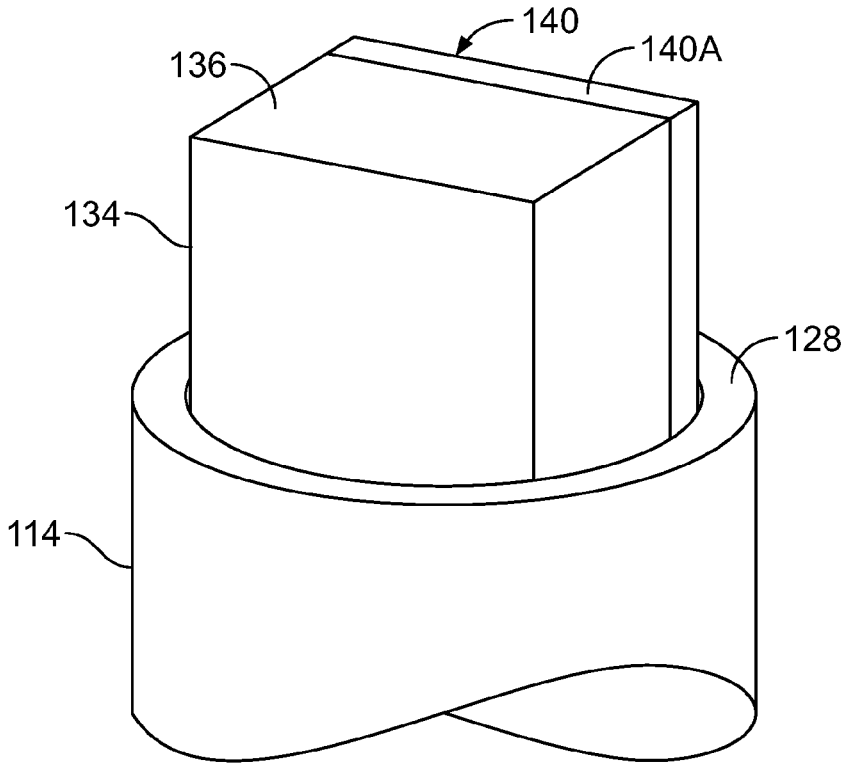
FIG. 4 is detailed, fragmentary, axonometric view of the upper portion of a device that is an alternate to the device of FIG. 1.

Referring to FIG. 4, an alternate device is illustrated. Components corresponding to those previously described in FIG. 1 will have the same reference numeral but increased by 100. Neck 114 is the same as the previously illustrated neck (neck 14 of FIG. 1) and is integral with a body (not shown) that is the same as that previously described in FIG. 1. In particular, the body associated with neck 114 will have a holding chamber and fluid chamber, the same as before. Essentially the difference in the embodiment of FIG. 4 is the shape of rubbing member 134 and scraping element 140.

Rubbing member 134 is a six-sided block of open cell melamine foam in the shape of a parallelepiped. Each of the sides of block 134 is parallel to its opposite side except for beveled distal face 136, which is tilted approximately 45° from the axis of neck 114. The face opposite distal face 136 (not shown) is perpendicular to the axis of neck 114. The other four faces of block 134 are parallel to the axis of neck 114, with one opposing pair of them having a trapezoidal outline.

Scraping element 140 is a relatively thin blade overlaying one of the trapezoidal faces of block 134, and having the same outline as that trapezoidal face. Distal edge 140A of scraping blade 140 is parallel to and coplanar with distal face 136, although in some embodiments edge 140A may protrude more or less than melamine block 134.

Melamine block 134 is wetted in a similar manner as before by means of a wick (not shown) This wick can be embedded in a slice, groove or bore (not shown) in block 134, or can be captured between block 134 and blade 140. Block 134 and blade 140 are forced fitted inside neck 114 to remain in place. The overall protrusion of block 134 and blade 140 is ¼ inch (6 mm), although a different amount of protrusion can be employed in other embodiments.

The device of FIG. 4 operates as before with blade 140 scraping away more of the scratch-off coating than melamine block 134, while the melamine block comminutes fragments of the coating into fine particles that migrate into the open cells of the melamine block. The beveling of face 136 and edge 140A allows the user to tilt the axis of the device at a comfortable angle, much like the angle used for a writing instrument, while still allowing face 136 and edge 140A to squarely abut the work surface.

Figure 5:
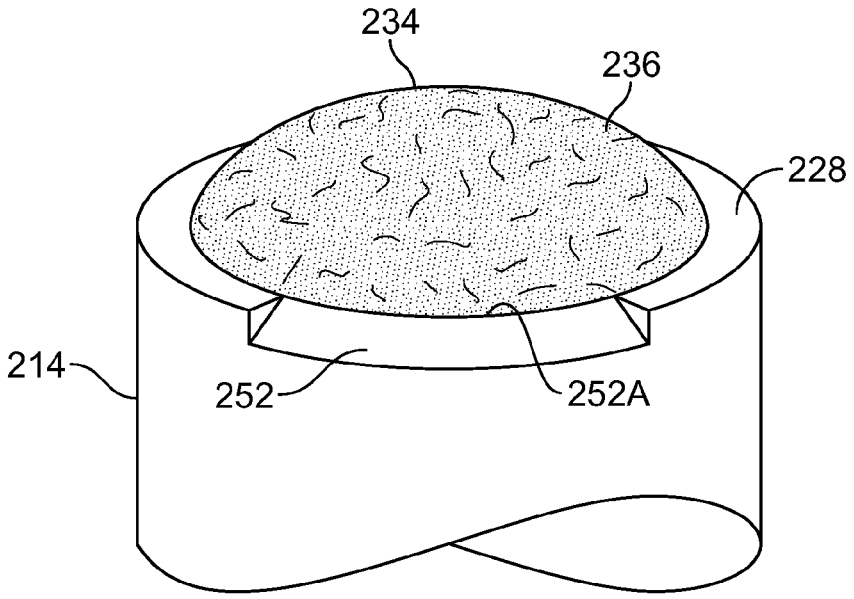
FIG. 5 is a detailed, fragmentary, axonometric view of the upper portion of a device that is an alternate to the devices of FIGS. 1 and 4.

Referring to FIG. 5, an alternate device is illustrated. Components corresponding to those previously described in FIG. 1 will have the same reference numeral but increased by 200. Neck 214 is similar to the previously illustrated neck (neck 14 of FIG. 1) and is integral with a body (not shown) that is the same as that previously described in FIG. 1. In particular, the body associated with neck 214 will have a holding chamber and fluid chamber, the same as before. Essentially the difference in the embodiment of FIG. 4 is the shape of rubbing member 234 and a modification to rim 228 in order to provide a different type of scraping element.

Melamine foam 234 is the same as before except that distal face 236 is rounded, thereby tolerating a varying angle of attack. Also no scraping element is embedded in melamine foam 234. Instead, a scraping element is provided by relieving a 90° sector of rim 228 into a beveled surface 252 that ascends to a pointed beveled edge 252A.

Melamine foam 234 is wetted in a similar manner as before by means of a wick (not shown). The overall protrusion of foam 234 is ⅛ inch (3 mm), although different amounts of protrusion can be employed in other embodiments.

The device of FIG. 5 operates as before with beveled edge 252A scraping away more of the scratch-off coating than melamine foam 234, while the melamine foam comminutes fragments of the coating into fine particles that migrate into the open cells of the melamine foam. The rounding of face 236 allows the user to tilt the axis of the device at a comfortable angle, much like the angle used for a writing instrument.

It is appreciated that various modifications may be implemented with respect to the above described embodiments. While the melamine foam is wetted with water, other types of fluids may be used including detergents, viscous liquids, fragrant liquids, or substances that will dissolve a scratch-off coating. Disclosed embodiments employed a wick to transfer fluid to melamine foam, but in some cases the wick may be eliminated and fluid will simply be metered through one or more apertures in the wall dividing the holding chamber from the fluid chamber. In some cases the wall will be eliminated or replaced with a coating on the inside face of the melamine foam. The foregoing devices were styled much like a writing instrument such as a marker, but in other embodiments the device can be relatively short and may have a variety of different shapes including shapes that are polyhedral, ovoid, etc. In some cases the package may have a recess into which a finger may be inserted. The size and shape of the device can be altered depending upon the desired capacity, portability, etc.

In some embodiments, the body (such as body 10) can have the shape of a large coin (e.g., 1.5 inches (3.8 cm) in diameter and 0.5 inch (1.3 cm) thick). The body can be assembled as two nestable cylinders that slide together and have on their edges aligned notches that allow passage of a wick A rectangular tube projects radially outward from the edge of the radially larger cylinder, in alignment with the matching notches. The melamine can be mounted proud, solely in this rectangular tube. The rectangular tube may have a tip that is beveled so the tube projects ⅜ inch (1 cm) from the obverse side and 1/16 inch (1.6 mm) from the reverse side (or vice versa). The tip is beveled about 45° relative to the axis of the body, and the axis of the rectangular tube. Other embodiments can have different or no beveling. The rectangular tube had in one embodiment an overall size of 5/16 inch (8 mm) in the axial direction (axis of the cylindrical body) and ⅜ inch (1 cm) in the direction transverse to the cylindrical axis and the axis of the tube. These dimensions can be varied in other embodiments, where the tube can be square, round, oval, or have other shapes. The wick can travel from the melamine in the tube, inwardly through the notches in the body, and against (or into) batting contained in the body. The batting can fill all or part of the body. The body may have an optional internal barrier to keep the batting in a restricted region. Instead of nested cylinders, in some embodiments the body may be a cylinder with a flat circular lid. In still other embodiments the body may be a squat parallelepiped with a melamine-containing tube projecting perpendicularly from one of its edges. In other embodiments the body can be lozenge-shaped.

Obviously, many modifications and variations of the present invention are possible in light of the above teachings. It is therefore to be understood that within the scope of the appended claims, the invention may be practiced otherwise than as specifically described.

The invention claimed is:

1. A device for removing a scratch-off coating that initially conceals information, comprising:

a rubbing member comprising an abrasive, open cell melamine foam that is wetted with water; and a structure including a body having a distal opening and a fluid chamber communicating with said distal opening, said rubbing member being mounted at said distal opening, said open cell foam having a distal end protruding from said distal opening, said structure comprising:

a scraping element located at said rubbing member, said scraping element comprising a stud mounted centrally in the distal end of said open cell foam.

2. A device according to claim 1 wherein said stud has a flared distal head and a proximal shank that is embedded coaxially in said open cell foam.

3. A device according to claim 1 wherein said body comprises:

a holding chamber located between said fluid chamber and said distal opening, said rubbing member being mounted in said holding chamber and extending to said distal opening, said holding chamber communicating with said fluid chamber and said distal opening.

4. A device removing a scratch-off coating that initially conceals information, comprising:

a rubbing member comprising an abrasive, open cell melamine foam that is wetted with water; and a structure including a body having a distal opening and a fluid chamber communicating with said distal opening, said rubbing member being mounted at said distal opening, said structure comprising:

a scraping element located at said rubbing member, said body comprising:

a neck with a rim at said distal opening surrounding at least part of said rubbing member, said scraping element comprising a pointed beveled edge formed along at least part of said rim.

5. A device for removing a scratch-off coating that initially conceals information, comprising:

a rubbing member comprising an abrasive, open cell melamine foam that is wetted with water; and a structure including a body having a distal opening and a fluid chamber communicating with said distal opening, said rubbing member being mounted at said distal opening, said structure comprising:

a scraping element located at said rubbing member said rubbing member comprising:

a block with a beveled distal face, said scraping element comprising a blade mounted alongside said block, said blade having a distal edge parallel to the beveled distal face of said block.

6. A device for removing a scratch-off coating that initially conceals information, comprising:

a rubbing member comprising an abrasive, open cell melamine foam that is wetted with water; and a structure including a body having a distal opening and a fluid chamber communicating with said distal opening, said rubbing member being mounted at said distal opening, said open cell foam having a distal end protruding from said distal opening, said structure comprising:

a scraping element located at said rubbing member, said body comprising:

a holding chamber located between said fluid chamber and said distal opening, said rubbing member being mounted in said holding chamber and extending to said distal opening, said holding chamber communicating with said fluid chamber and said distal opening; and a transverse perforated wall between said fluid chamber and said holding chamber, said wall being opposite said distal opening.

7. A device according to claim 6 comprising:

a wick routed from said fluid chamber to said holding chamber; and absorbent batting mounted in said fluid chamber and wetted with water.

8. A device according to claim 7 wherein said body has an external surface with at least a portion thereof being cylindrical.

9. A device according to claim 8 wherein said body comprises a neck surrounding at least a portion of said rubbing member, said device comprising:

a cap sized to fit around said neck and to cover said rubbing member.

10. A device according to claim 9 wherein said body has a cavity opposite said distal opening, said cavity being adapted to hold said cap.

11. A device for removing a scratch-off coating that initially conceals information, comprising:

a compressible rubbing member comprising an open cell foam; and a structure including a body having a distal opening and a fluid chamber communicating with said distal opening, said rubbing member being mounted at said distal opening, said rubbing member having a distal end protruding from said distal opening, said structure comprising:

a scraping element located at said rubbing member, said scraping element comprising a stud mounted centrally in the distal end of said open cell foam.

12. A device for removing a scratch-off coating that initially conceals information, comprising:

a compressible rubbing member; and a structure including a body having a distal opening and a fluid chamber communicating with said distal opening, said rubbing member being mounted at said distal opening, said structure comprising:

a scraping element located at said rubbing member, said body comprising:

a neck at said distal opening with a rim surrounding at least part of said rubbing member, said scraping element comprising a pointed beveled edge formed along at least part of said rim.

13. A device for removing a scratch-off coating that initially conceals information, comprising:

a compressible rubbing member; and a structure including a body having a distal opening and a fluid chamber communicating with said distal opening, said rubbing member being mounted at said distal opening, said structure comprising:

a scraping element located at said rubbing member, said rubbing member comprising:

a block with a beveled distal face, said scraping element comprising a blade mounted alongside said block, said blade having a distal edge parallel to the beveled distal face of said block.

14. A device for removing a scratch-off coating that initially conceals information, comprising:

a compressible rubbing member; and a structure including a body having a distal opening and a fluid chamber communicating with said distal opening, said rubbing member being mounted at said distal opening, said structure comprising:

a scraping element located at said rubbing member, said body comprising:

a holding chamber located between said fluid chamber and said distal opening, said rubbing member being mounted in said holding chamber and extending to said distal opening, said holding chamber communicating with said fluid chamber and said distal opening;

a transverse perforated wall between said fluid chamber and said holding chamber, said wall being opposite said distal opening;

a wick routed from said fluid chamber to said holding chamber; and absorbent batting mounted in said fluid chamber and wetted with water.

15. A device for removing a scratch-off coating that initially conceals information, comprising:

a rubbing member having a distal end and including a melamine open cell foam that is abrasive and wetted with water; and a structure including a body having a distal opening, said body having an external surface with at least a portion thereof being cylindrical, said rubbing member being mounted at said distal opening, said structure comprising:

a scraping element located at said rubbing member, said body including:

a neck at said distal opening with a rim surrounding at least part of said rubbing member;

a fluid chamber communicating with said distal opening;

a holding chamber located between said fluid chamber and said distal opening, said rubbing member being mounted in said holding chamber and extending to said distal opening, said holding chamber communicating with said fluid chamber and said distal opening;

a transverse perforated wall between said fluid chamber and said holding chamber, said wall being opposite said distal opening;

a wick routed from said fluid chamber to said holding chamber; and absorbent batting mounted in said fluid chamber and wetted with water, said device comprising:

a cap sized to fit around said neck and to cover said rubbing member, said body having a cavity opposite said distal opening, said cavity being adapted to hold said cap.

* * * * *